US011187408B2

(12) United States Patent
Hausen et al.

(10) Patent No.: US 11,187,408 B2
(45) Date of Patent: Nov. 30, 2021

(54) APPARATUS AND METHOD FOR VARIABLE MODE MIXING OF COMBUSTION REACTANTS

(71) Applicant: Fives North American Combustion, Inc., Cleveland, OH (US)

(72) Inventors: David S. Hausen, Huntsville, AL (US); Dennis E. Quinn, Hinckley, OH (US); Ashley N. Graybill, Shaker Heights, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 414 days.

(21) Appl. No.: 16/394,577

(22) Filed: Apr. 25, 2019

(65) Prior Publication Data

US 2020/0340667 A1 Oct. 29, 2020

(51) Int. Cl.
*F23D 14/64* (2006.01)
*F23D 14/02* (2006.01)

(52) U.S. Cl.
CPC ..... *F23D 14/64* (2013.01); *F23D 14/02* (2013.01); *F23D 2900/00003* (2013.01)

(58) Field of Classification Search
CPC ..... F23D 14/64; F23D 14/02; F23D 2900/00003; F23D 14/22; F23D 2900/00008; F23D 14/10; F23D 14/105
See application file for complete search history.

(56) References Cited

U.S. PATENT DOCUMENTS 3,418,060 A * 12/1968 Spielman ..... F23D 14/00 431/158
3,748,087 A * 7/1973 Shular ..... F23D 17/002 431/182
4,077,761 A * 3/1978 Dollinger ..... C09C 1/50 422/150
4,165,364 A * 8/1979 Dollinger ..... C09C 1/50 422/151
4,214,866 A 7/1980 Thekdi et al.
4,373,325 A 2/1983 Shekleton
4,525,138 A * 6/1985 Snyder ..... F23M 11/045 239/419

(Continued)

FOREIGN PATENT DOCUMENTS

EP 809070 B1 8/2001
EP 2500645 B1 1/2015

(Continued)

*Primary Examiner* — Jorge A Pereiro
(74) *Attorney, Agent, or Firm* — Benesch, Friedlander, Coplan & Aronoff LLP

(57) ABSTRACT

An apparatus includes first and second mixer tubes. The first mixer tube contains a first gas flow passage having an inlet communicating with the source of fuel gas and an outlet to a combustion chamber. The second mixer tube contains a second gas flow passage having an inlet communicating with the source of combustion air and an outlet to the combustion chamber. The apparatus further includes premix control means for forming fuel gas-combustion air premix in the second passage by directing fuel gas from the first passage into the second passage, and for alternatively forming fuel gas-combustion air premix in the first passage by directing combustion air from the second passage into the first passage.

13 Claims, 2 Drawing Sheets

(56) References Cited

U.S. PATENT DOCUMENTS 4,902,222 A * 2/1990 van Belle ..... F24H 3/0488 431/126
5,049,066 A * 9/1991 Kaiya ..... F23D 14/00 431/352
5,269,679 A 12/1993 Syska et al.
5,292,244 A 3/1994 Xiong
5,569,020 A * 10/1996 Griffin ..... F23C 13/08 431/284
5,584,182 A 12/1996 Althaus et al.
5,791,889 A * 8/1998 Gemmen ..... F23R 3/28 431/1
5,857,846 A * 1/1999 Sattelmayer ..... F23D 17/00 431/284
6,461,147 B1 * 10/2002 Sonju ..... F23D 14/02 431/182
6,672,862 B2 1/2004 Neville et al.
6,843,185 B1 * 1/2005 Taylor ..... F23C 9/003 110/261
8,424,311 B2 4/2013 York et al.
8,662,887 B2 3/2014 Cain et al.
8,920,159 B2 * 12/2014 Taylor ..... F23C 9/00 431/187
9,982,885 B2 5/2018 Taylor et al.
10,072,848 B2 9/2018 Berry et al.
2004/0194681 A1 * 10/2004 Taylor ..... F23C 6/045 110/261
2006/0199119 A1 * 9/2006 Abbasi ..... F23D 14/66 431/8
2013/0203003 A1 8/2013 Cain et al.
2013/0309617 A1 * 11/2013 Haneji ..... F23C 7/02 431/12
2016/0169505 A1 6/2016 Ilchenko et al.
2019/0072274 A1 * 3/2019 Maitani ..... F23C 3/002

FOREIGN PATENT DOCUMENTS

EP 2216599 8/2017
JP 01252807 A 10/1989
JP 2001263609 A 9/2001

* cited by examiner

APPARATUS AND METHOD FOR VARIABLE MODE MIXING OF COMBUSTION REACTANTS

TECHNICAL FIELD

This technology includes an apparatus and method for suppressing the production of NOx in a furnace combustion chamber, and particularly relates to the use of fuel-oxidant premix as a reactant to suppress the production of NOx.

BACKGROUND

The premixing of a fuel and an oxidant (typically combustion air) is common in many combustion processes. Thorough mixing has the advantage of an inlet stream combusting at a consistent fuel-to-air ratio. This premixing can be used for precise control of the combustion process, such as in the case of lean premix to limit combustion temperatures, resulting in significant reduction in the production and emission of NOx, a regulated pollutant.

Premix is limited with respect to thermal turndown, which is the ratio of the highest input to the lowest input. At a certain turndown ratio, the flow velocity of the premix is overcome by the flame speed of the premix, at which point flashback (the burning of the mixture back to the point of mixing) can occur, leading to deterioration in performance as well as damage to equipment. Complicated control systems are often programmed to facilitate operation near the point of flashback, but the systems are still limited by the physics of the flashback process.

SUMMARY OF THE INVENTION

An apparatus is provided for use with a source of fuel gas, a source of combustion air, and a furnace structure defining a combustion chamber. The apparatus includes first and second mixer tubes. The first mixer tube contains a first gas flow passage. The first gas flow passage has an inlet communicating with the source of fuel gas, and has an outlet to the combustion chamber. The second mixer tube contains a second gas flow passage, which has an inlet communicating with the source of combustion air and an outlet to the combustion chamber. The apparatus further includes premix control means for forming fuel gas-combustion air premix in the second passage by directing fuel gas from the first passage into the second passage. The premix control means alternatively forms fuel gas-combustion air premix in the first passage by directing combustion air from the second passage into the first passage.

In a given example, the premix control means directs fuel gas from the first passage into the second passage under the influence of a pressure drop from the first passage to the second passage. The premix control means alternatively directs combustion air from the second passage into the first passage under the influence of a pressure drop from the second passage to the first passage.

In another alternative, the premix control means directs only fuel gas into the first passage, while directing only combustion air into the second passage, with no substantial pressure differential between the first passage and the second passage.

A method of injecting reactants into a combustion chamber also is provided. The method injects the reactants from a burner having first and second gas flow passages. In a first mode, a premix of fuel gas and combustion air is injected from one of the passages. Fuel gas without combustion air is simultaneously injected from the other passage. Alternatively, in a second mode, a premix of fuel gas and combustion air is injected from one of the passages while combustion air without fuel gas is injected from the other passage. The method includes switching between the first and second modes in response to a pressure differential between the first and second passages.

The method can include a third mode that injects fuel gas without combustion air from one of the passages, while injecting combustion air without fuel gas from the other passage. The mode of operation can be switched to the third mode from either of the first and second modes in response to an equalization of pressures in the first and second passages.

In a given example, the method includes a step of directing fuel gas into a first gas flow passage having an outlet to the combustion chamber, and a step of directing combustion air into a second gas flow passage having an outlet to the combustion chamber. Premix is formed in alternative modes. In a first mode, fuel gas is directed from the first passage into the second passage to form premix in the second passage. In a second mode, combustion air is directed from the second passage into the first passage to form premix in the first passage.

The first mode can be a higher firing mode in which fuel gas is directed into the first passage at a pressure in a first range. The second mode can be a lower firing mode in which fuel gas is directed into the first passage at a pressure in a second range below the first range. In a third mode, only fuel gas is directed into the first passage, and only combustion air is directed into the second passage. The third mode is a premix-free mode in which the fuel gas is directed into the first passage at an intermediate pressure between the first range and the second range.

DETAILED DESCRIPTION

Figure 1:
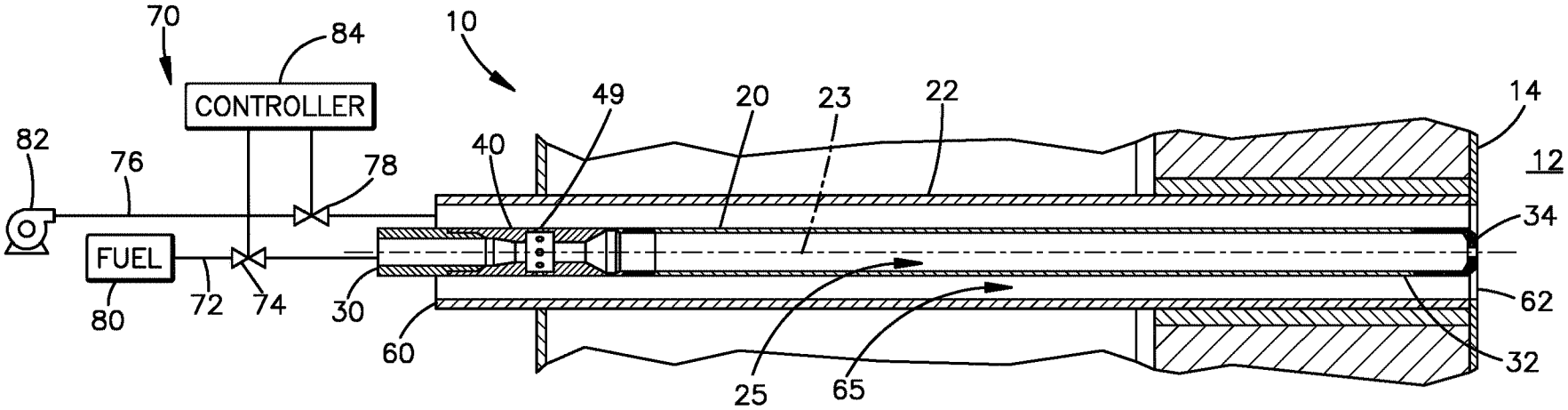
FIG. 1 is a schematic view of parts of a furnace including a burner that fires into a process chamber.

The apparatus shown schematically in the drawings has parts that are examples of the elements recited in the apparatus claims, and can be operated in steps that are examples of the steps recited in the method claims. These examples are described here to provide enablement and best mode without imposing limitations that are not recited in the claims.

As shown in FIG. 1, an apparatus includes a burner 10 that is part of an industrial furnace having a combustion chamber 12. The burner 10 is mounted on a furnace wall 14 adjoining the combustion chamber 12, and operates to discharge reactants into the combustion chamber 12. The reactants discharged from the burner 10 provide products of combustion for a heating process to be performed on a load (not shown) in the chamber 12.

In this example the burner 10 is a premix burner with inner and outer mixer tubes 20 and 22. The inner mixer tube 20 is centered on a longitudinal axis 23, and contains a first gas flow passage 25 reaching from an inlet end 30 of the tube 20 to an outlet end 32. A pilot nozzle 34 is mounted on the outlet end 32 of the tube 20 to communicate the gas flow passage 25 with the process chamber 12.

Figure 2:
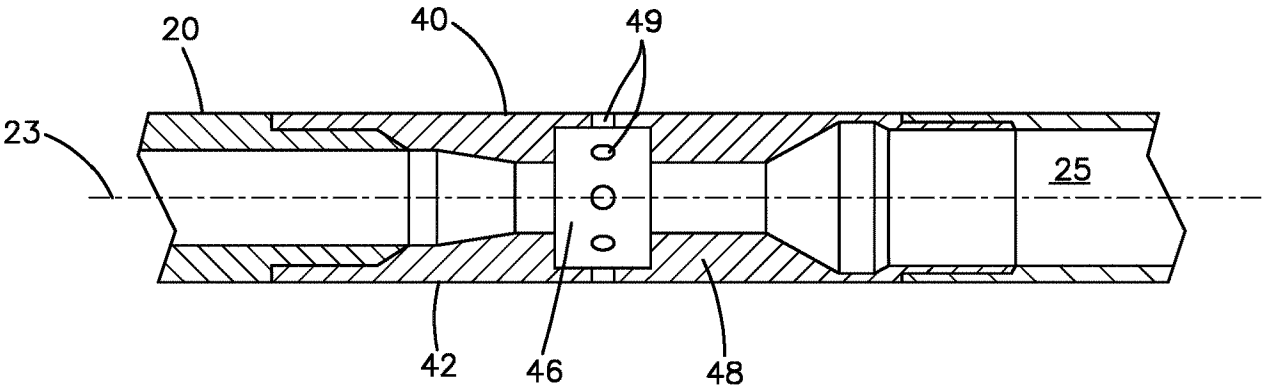
FIG. 2 is an enlarged view of parts shown in FIG. 1.

The inner mixer tube 20 further includes a jet pump 40 defining an upstream portion of the first gas flow passage 25. As shown in enlarged detail in FIG. 2, the jet pump 40 has coaxial sections including a nozzle 42, a mixing chamber 46, and a throat 48. The mixing chamber 46 reaches axially from the nozzle 42 to the throat 48, and has a circumferential array of cross-jet mixing holes 49.

Referring again to FIG. 1, the outer mixer tube 22 has inlet and outlet ends 60 and 62, and reaches coaxially over the inner mixer tube 20. In this configuration, the outer mixer tube 22 contains a second gas flow passage 65 having an annular configuration radially between the two mixer tubes 20 and 22. The cross-jet mixing holes 49 at the jet pump 40 provide gas pressure and flow communication radially between the two gas flow passages 25 and 65.

As further shown schematically in FIG. 1, the burner 10 is connected in a reactant supply and control system 70 including a fuel line 72 with a fuel valve 74 and an air line 76 with an air valve 78. Although FIG. 1 shows a single fuel valve 74 and a single air valve 78 for clarity of illustration, each of these schematic representations 74 and 78 may include multiple valves as needed for any particular implementation of the reactant supply and control system 70.

The fuel line 72 reaches from a fuel source 80, such as a plant supply of natural gas, to the inlet end 30 of the first gas flow passage 25. The air line 76 reaches from a source of combustion air, such as a blower 82, to the inlet end 60 of the second gas flow passage 65. A controller 84 operates the fuel and air valves 74 and 78 to initiate, regulate, and terminate flows of fuel gas and combustion air to the burner 10. The controller 84 may comprise any suitable programmable logic controller or other control device, or combination of control devices, that can be programmed or otherwise configured to perform as described and claimed herein.

Figure 3:
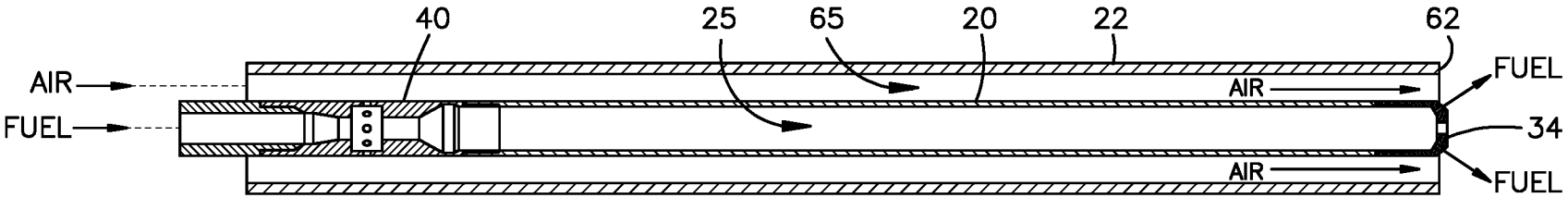
FIG. 3 is view similar to FIG. 1, illustrating a mode of operation for the burner.

Specifically, the controller 84 is configured to operate the fuel and air valves 74 and 78 in a number of differing modes. In one such mode, the controller 84 directs the fuel valve 74 to provide the first gas flow passage 25 with a stream of fuel gas at a first pressure. The controller 84 simultaneously directs the air valve 78 to provide the second gas flow passage 65 with a stream of combustion air at a second pressure that is equal or substantially equal to the first pressure. With equal or substantially equal pressures at the fuel and air streams, there is no substantial pressure differential radially through the cross-jet mixing holes 49 at the jet pump 40. The fuel gas then flows through the jet pump 40 axially past the cross-jet mixing holes 49, and further through the first gas flow passage 25 to the pilot nozzle 34 from which it enters the combustion chamber 12. This is indicated schematically in FIG. 3. The combustion air stream likewise flows through the second gas flow passage 65 axially past the cross-jet mixing holes 49 and further to the outlet 62 from which it enters the combustion chamber 12. With only fuel gas directed into the first gas flow passage 25, and only combustion air directed into the second gas flow passage 65, this is a premix-free mode of operation in which there is no substantial mixing of fuel gas and combustion air within the burner 10.

The premix-free mode of operation can be an intermediate mode in which the fuel gas pressure has a midpoint or other intermediate level. The intermediate pressure level can be, for example, 25% of available fuel gas pressure input. Accordingly, the burner 10 can be shifted from the intermediate mode of operation to an alternative mode by shifting the fuel gas pressure up or down from the intermediate level. If the intermediate level of fuel gas pressure is equal or substantially equal to the combustion air pressure as described above, shifting the fuel gas pressure away from the intermediate level will induce a pressure differential between the two reactant streams. A pressure drop will then act radially through the cross-jet mixing holes 49 between the first and second gas flow passages 25 and 65. A sufficient change in pressure will induce a pressure drop sufficient to drive either fuel gas or combustion air radially from the passage of higher pressure to the passage of lower pressure, thus forming premix in the passage of lower pressure.

Figure 4:
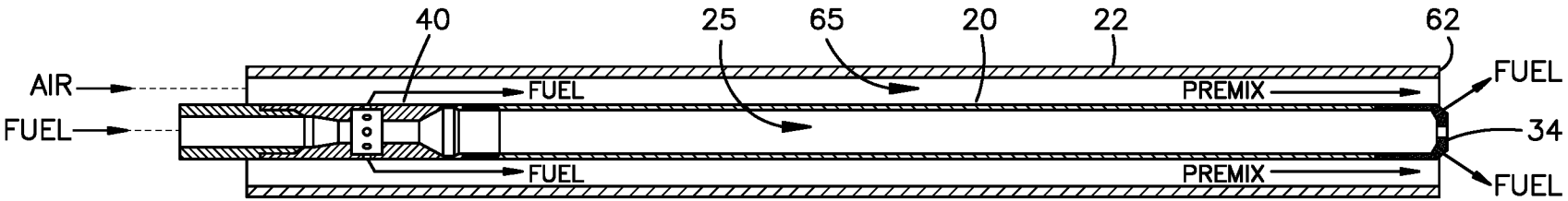
FIG. 4 is view similar to FIG. 1, illustrating an alternative mode of operation for the burner.

For example, the controller 84 can operate the fuel valve 74 to increase the fuel gas pressure into a range above the intermediate level, including a level approaching or reaching 100% of available input. This will shift the burner 10 from the intermediate mode to a high-fire mode. In the high-fire range of fuel gas pressures at the first passage 25, the pressure drop to the second passage 65 will drive some of the fuel gas to flow radially outward through the cross-jet mixing holes 49. That fuel gas will mix with the combustion air in the second passage 65 to form premix as the two reactants flow axially toward the outlet 62. The premix will then emerge from the outlet 62 and mix further with the fuel gas emerging from the pilot nozzle 34. This is indicated schematically in FIG. 4. Since the first passage 25 receives only fuel gas in this mode of operation, premix is formed only in the second passage 65. In this manner the high-fire mode of burner 10 operation injects streams of fuel gas without combustion air into the combustion chamber 12 at the pilot nozzle 34 in addition to injecting premix into the combustion chamber 12 at the annular outlet 62.

Figure 5:
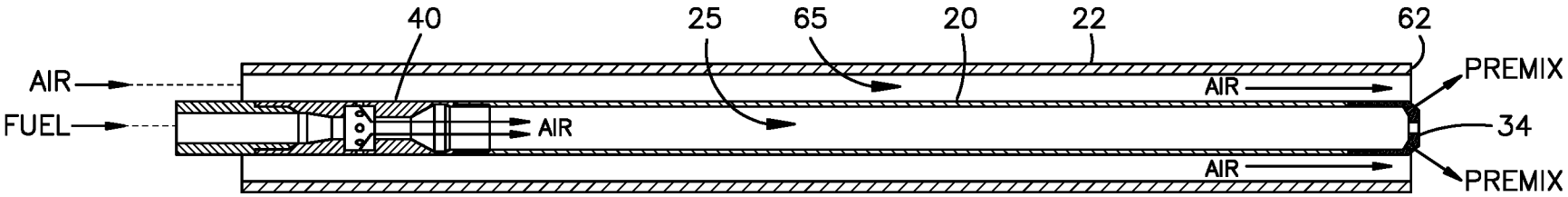
FIG. 5 is view similar to FIG. 1, illustrating another alternative mode of operation for the burner.

Alternatively, the controller 84 can operate the fuel valve 74 to decrease the fuel gas pressure into a range below the intermediate level, including a level of, for example, 10% of available input. This would shift the burner 10 to a low-fire mode. In the low-fire range of fuel gas pressures at the first passage 25, the pressure drop from the second passage 65 to the first passage 25 will drive some of the combustion air to flow radially inward through the cross-jet mixing holes 49. That combustion air will mix with the fuel gas in the first passage 25 to form premix as the two reactants flow axially toward the pilot nozzle 34. The premix will then emerge from the pilot nozzle 34 in streams that mix further with the combustion air emerging from the surrounding annular outlet 62 of the second gas flow passage 65, as indicated schematically in FIG. 5. Since the second gas flow passage 65 receives only combustion air, premix is formed only in the first passage 25. The reactant streams injected from the burner 10 into the combustion chamber 12 in the low-fire mode thus include only the stream of combustion air at the annular outlet 62 in addition to the streams of premix at the pilot nozzle 34.

The foregoing examples control a pressure differential between the two reactant streams by regulating the fuel gas pressure while maintaining a constant level of combustion air pressure. However, a pressure differential for forming premix can be induced or regulated by a change in either reactant pressure relative to the other. This can be accomplished, for example, by regulating the combustion air pressure while maintaining a constant level of fuel gas pressure, by increasing or decreasing both reactant pressures unequally, or by decreasing one reactant pressure while increasing the other. In each case, the mode of operation can be switched to the high-fire mode from either the intermediate mode or the low-fire mode by inducing a sufficient pressure drop from the first gas flow passage 25 to the second gas flow passage 65. The mode of operation can likewise be switched to the low-fire mode from either the intermediate mode or the high-fire mode by inducing a sufficient pressure drop from the second gas flow passage 65 to the first gas flow passage 25. The mode can also be switched to the intermediate mode from either the high-fire mode or the low-fire mode by equalizing the pressures in the first and second passages 25 and 65.

The invention can provide premix while simultaneously preventing flashback in the burner 10 throughout a wide operating range of firing levels. A fuel stream of relatively low velocity can be susceptible to flashback. In a high-fire mode, flashback is avoided by forming premix in the second gas flow passage 65 while the velocity of the fuel stream in the first gas flow passage 25 is high enough to prevent flashback. In a low-fire mode, flashback is avoided by forming premix in the first gas flow passage 25 where the relatively low velocity fuel would otherwise be susceptible to flashback. This avoids the risk of flashback at turndown ratios approaching or reaching lower stabilization limits, which provides a correspondingly greater range of firing levels without flashback.

This written description sets for the best mode of carrying out the invention, and describes the invention so as to enable a person skilled in the art to make and use the invention, by presenting examples of the elements recited in the claims. The patentable scope of the invention is defined by the claims, and may include other examples that do not differ from the literal language of the claims, as well as equivalent examples with insubstantial differences from the literal language of the claims.

What is claimed is:

1. A method of injecting reactants into a combustion chamber, the reactants comprising fuel gas and combustion air, the method comprising:

injecting the reactants into the combustion from a burner having first and second gas flow passages, including:

injecting the reactants in a first mode that injects fuel gas-combustion air premix from one of the passages while injecting fuel gas without combustion air from the other of the passages; and injecting the reactants in a second mode that injects fuel gas-combustion air premix from one of the passages while injecting combustion air without fuel gas from the other of the passages; and switching between the first mode and the second mode in response to a pressure differential between the first and second passages.

2. A method as defined in claim 1 wherein the first mode injects fuel gas-combustion air premix from the second passage while injecting fuel gas without combustion air from the first passage, and the second mode injects fuel gas-combustion air premix from the first passage while injecting combustion air without fuel gas from the second passage.

3. A method as defined in claim 2 wherein the switching step switches from the first mode to the second mode in response to a pressure drop from the second passage to the first passage, and switches from the second mode to the first mode in response to a pressure drop from the first passage to the second passage.

4. A method as defined in claim 1 further comprising injecting the reactants in a third mode that injects fuel gas without combustion air from one of the passages while injecting combustion air without fuel gas from the other of the passages.

5. A method as defined in claim 4 further comprising switching to the third mode from either the first mode or the second mode in response to an equalization of pressures in the first and second passages.

6. An apparatus for use with a source of fuel gas, a source of combustion air, and a furnace structure defining a combustion chamber, comprising:

a first mixer tube containing a first gas flow passage, wherein the first passage has an inlet communicating with the source of fuel gas and an outlet to the combustion chamber;

a second mixer tube containing a second gas flow passage, wherein the second passage has an inlet communicating with the source of combustion air and an outlet to the combustion chamber; and premix control means for forming fuel gas-combustion air premix in the second passage by directing fuel gas from the first passage into the second passage, and for alternatively forming fuel gas-combustion air premix in the first passage by directing combustion air from the second passage into the first passage;

wherein the premix control means directs fuel gas from the first passage into the second passage under the influence of a pressure drop from the first passage to the second passage, and alternatively directs combustion air from the second passage into the first passage under the influence of a pressure drop from the second passage to the first passage; and the premix control means alternatively directs only fuel gas into the first passage, while simultaneously directing only combustion air into the second passage, with no substantial pressure differential between the first passage and the second passage.

7. An apparatus for use with a source of fuel gas, a source of combustion air, and a furnace structure defining a combustion chamber, comprising:

a first mixer tube containing a first gas flow passage, wherein the first passage has an inlet communicating with the source of fuel gas and an outlet to the combustion chamber;

a second mixer tube containing a second gas flow passage, wherein the second passage has an inlet communicating with the source of combustion air and an outlet to the combustion chamber; and premix control means for forming fuel gas-combustion air premix in the second passage by directing fuel gas from the first passage into the second passage, and for alternatively forming fuel gas-combustion air premix in the first passage by directing combustion air from the second passage into the first passage;

wherein the premix control means forms fuel gas-combustion air premix in the second passage by directing fuel gas from the first passage into the second passage in a higher firing mode in which fuel gas is directed into the first passage at a pressure in a first range, and alternatively forms fuel gas-combustion air premix in the first passage by directing combustion air from the second passage into the first passage in a lower firing mode in which fuel gas is directed into the first passage at a pressure in a second range lower than the first range.

8. An apparatus as defined in claim 7, wherein the premix control means alternatively directs only fuel gas into the first passage, while directing only combustion air into the second passage, in a premix-free intermediate firing mode in which fuel gas is directed into the first passage at a pressure between the first range and the second range.

9. An apparatus for use with a source of fuel gas, a source of combustion air, and a furnace structure defining a combustion chamber, comprising:

a first mixer tube containing a first gas flow passage, wherein the first passage has an inlet communicating with the source of fuel gas and an outlet to the combustion chamber;

a second mixer tube containing a second gas flow passage, wherein the second passage has an inlet communicating with the source of combustion air and an outlet to the combustion chamber; and premix control means for forming fuel gas-combustion air premix in the second passage by directing fuel gas from the first passage into the second passage, and for alternatively forming fuel gas-combustion air premix in the first passage by directing combustion air from the second passage into the first passage;

wherein the first mixer tube defines the first passage as an inner passage having a longitudinal axis, and the second mixer tube reaches over the first mixer tube to define the second passage as annular passage radially between the first mixer tube and the second mixer tube;

the premix control means directs fuel gas radially from the inner passage to the annular passage under the influence of a pressure drop from the inner passage to the annular passage, and alternatively directs combustion air radially from the annular passage to the inner passage under the influence of a pressure drop from the annular passage to the inner passage; and the premix control means alternatively directs only fuel gas into the first passage, while simultaneously directing only combustion air into the second passage, with no substantial pressure differential between the inner passage and the annular passage.

10. An apparatus for use with a source of fuel gas, a source of combustion air, and a furnace structure defining a combustion chamber, the apparatus comprising:

a first mixer tube defining an inner gas flow passage having a longitudinal axis, an inlet communicating with the source of fuel gas, and an outlet to the combustion chamber;

a second mixer tube reaching over the first mixer tube and defining an annular gas flow passage radially between the first mixer tube and the second mixer tube, wherein the annular passage has an inlet communicating with the source of combustion air and an outlet to the combustion chamber; and a jet pump configured to direct flows of gas radially between the inner passage and the annular passage under the influence of pressure differentials between the inner passage and the annular passage;

wherein the jet pump is configured to direct fuel gas radially from the inner passage to the annular passage under the influence of a pressure drop from the inner passage to the annular passage, and to direct combustion air radially from the annular passage to the inner passage under the influence of a pressure drop from the annular passage to the inner passage; and the jet pump is further configured to direct only fuel gas through the inner passage with no substantial pressure differential between the inner passage and the annular passage.

11. A method of directing fuel gas and combustion air into a furnace combustion chamber, comprising:

directing fuel gas into a first gas flow passage having an outlet to the combustion chamber;

directing combustion air into a second gas flow passage having an outlet to the combustion chamber; and forming fuel gas-combustion air premix in alternative modes including a first mode in which fuel gas is directed from the first passage into the second passage to form premix in the second passage, and a second mode in which combustion air is directed from the second passage into the first passage to form fuel gas-combustion air premix in the first passage;

wherein fuel gas-combustion air premix is formed in the first mode by directing fuel gas from the first passage into the second passage under the influence of a pressure drop from the first passage to the second passage, and fuel gas-combustion air premix is formed in the second mode by directing combustion air from the second passage into the first passage under the influence of a pressure drop from the second passage to the first passage; and only fuel gas is directed into the first passage, while only combustion air is directed into the second passage, in a premix-free mode with no substantial pressure differential between the first passage and the second passage.

12. A method of directing fuel gas and combustion air into a furnace combustion chamber, comprising:

directing fuel gas into a first gas flow passage having an outlet to the combustion chamber;

directing combustion air into a second gas flow passage having an outlet to the combustion chamber; and forming fuel gas-combustion air premix in alternative modes including a first mode in which fuel gas is directed from the first passage into the second passage to form premix in the second passage, and a second mode in which combustion air is directed from the second passage into the first passage to form fuel gas-combustion air premix in the first passage;

wherein the first mode is a higher firing mode in which fuel gas is directed into the first passage at a pressure in a first range, and the second mode is a lower firing mode in which fuel gas is directed into the first passage at a pressure in a second range below the first range.

13. A method as defined in claim 12 wherein only fuel gas is directed into the first passage, while only combustion air is directed into the second passage, in a premix-free mode in which fuel gas is directed into the first passage at an intermediate pressure between the first range and the second range.

* * * * *